US010539092B2

(12) United States Patent
Scharf et al.

(10) Patent No.: US 10,539,092 B2
(45) Date of Patent: Jan. 21, 2020

(54) INTERNAL COMBUSTION ENGINE, ESPECIALLY RECIPROCATING INTERNAL COMBUSTION ENGINE

(71) Applicant: MAN TRUCK & BUS AG, München (DE)

(72) Inventors: Peter Scharf, Nürnberg (DE); Stefan Schmidt, Heroldsberg (DE)

(73) Assignee: MAN Truck & Bus AG, Munich (DE)

( * ) Notice: Subject to any disclaimer, the term of this patent is extended or adjusted under 35 U.S.C. 154(b) by 0 days.

(21) Appl. No.: 15/629,370

(22) Filed: Jun. 21, 2017

(65) Prior Publication Data

US 2017/0370322 A1 Dec. 28, 2017

(30) Foreign Application Priority Data

Jun. 23, 2016 (DE) ..... 10 2016 007 727

(51) Int. Cl.
*F02F 1/00* (2006.01)
*F02F 1/20* (2006.01)
*F02B 61/00* (2006.01)

(52) U.S. Cl.
CPC ..... *F02F 1/20* (2013.01); *F02F 1/004* (2013.01); *F02B 61/00* (2013.01)

(58) Field of Classification Search
CPC ..... F02F 1/004; F02F 2001/006
USPC ..... 123/193.2
See application file for complete search history.

(56) References Cited

U.S. PATENT DOCUMENTS 2,108,392 A * 2/1938 Sanders ..... F02F 1/16 92/169.1
3,620,137 A * 11/1971 Prasse ..... F02F 1/10 92/159
4,044,217 A * 8/1977 Otsuki ..... B23K 20/08 219/78.11
2005/0279296 A1* 12/2005 Coney ..... F02B 77/11 123/41.84
2007/0234994 A1* 10/2007 Wang ..... F02F 1/18 123/193.1
2013/0213217 A1* 8/2013 Jenness ..... F16J 9/06 92/172
2013/0340700 A1* 12/2013 Donahue ..... F02F 1/004 123/193.2

(Continued)

FOREIGN PATENT DOCUMENTS

DE 3123080 8/1982
DE 112014003421 6/2016

(Continued)

*Primary Examiner* — Long T Tran
*Assistant Examiner* — James J Kim
(74) *Attorney, Agent, or Firm* — Cozen O'Connor

(57) ABSTRACT

An internal combustion engine with at least one cylinder having a cylinder barrel that forms a guide for a piston associated with the cylinder. The cylinder barrel is only partially formed by a cylinder wall of a crankcase or of a cylinder liner fastened to the crankcase. The cylinder barrel, in a central region as seen in the cylinder axial direction, is formed by the cylinder wall. The cylinder wall, in an upper region of the cylinder barrel adjoining the central region and/or in a lower region adjoining the central region, has an encompassing recess into which is inserted a one-piece or multi-piece annular sliding element, the radially inner wall of which forms a part of the cylinder barrel.

22 Claims, 3 Drawing Sheets

(56) References Cited

U.S. PATENT DOCUMENTS

| | | | | |
|---|---|---|---|---|
| 2014/0318315 | A1* | 10/2014 | Suhonen | C23C 4/04 75/230 |
| 2016/0002769 | A1* | 1/2016 | Fujii | C23C 14/505 204/192.12 |
| 2016/0115589 | A1* | 4/2016 | Kobayashi | C23C 16/26 428/34.1 |
| 2016/0153392 | A1 | 6/2016 | Meirelles Tomanik | |

FOREIGN PATENT DOCUMENTS

| | | |
|---|---|---|
| GB | 600156 | 4/1948 |
| JP | S 60-155665 | 8/1985 |
| JP | S 61-241564 | 10/1986 |
| JP | H 10-246146 | 9/1998 |
| JP | H 11-311501 | 11/1999 |

* cited by examiner

INTERNAL COMBUSTION ENGINE, ESPECIALLY RECIPROCATING INTERNAL COMBUSTION ENGINE

BACKGROUND OF THE INVENTION

1. Field of the Invention

The invention relates to an internal combustion engine, especially to a reciprocating internal combustion engine, a cylinder liner set, and also to a vehicle, especially to a commercial vehicle, having an internal combustion engine.

2. Description of the Related Art

Internal combustion engines, especially reciprocating internal combustion engines, usually have at least one cylinder that has a cylinder barrel as a guide for a piston which is associated with the cylinder. For reducing the friction between a cylinder wall, which forms the cylinder barrel, and the associated piston or the piston rings of the piston, it is known to provide the piston rings with a friction-reducing coating. The coating in this case can be formed by a PVD coating (PVD: Physical Vapour Deposition) or a PA-CVD coating (Plasma-Assisted Chemical Vapour Deposition), especially by DLC coatings (DLC: Diamond-Like Carbon Coating). By reducing the friction between the cylinder wall and the associated piston or the piston rings, the fuel consumption and the emissions of the internal combustion engine and also the wear of the mutually rubbing components are significantly reduced.

Furthermore, it is also known to provide the cylinder wall that forms the cylinder barrel, especially in mixed friction regions of the cylinder barrel, with a friction-reducing coating in order to reduce the friction between the cylinder wall and the associated piston. Such a coating can be formed for example by a thermal spray coating or also by a DLC coating, especially in conjunction with laser texturing.

The coating of the cylinder barrel or of the cylinder wall, which forms the cylinder barrel is, however, frequently difficult since the cylinder wall, especially on account of the diameter/height ratio of the cylinder, is as a rule only accessible with difficulty. The coating cannot therefore often be applied with the desired coating quality.

SUMMARY OF THE INVENTION

It is therefore an object of the invention to provide an internal combustion engine, especially a reciprocating internal combustion engine, in which the friction between the cylinder barrel and the associated piston or the piston rings of the piston is reduced in a simple manner with regard to production engineering.

Proposed is an internal combustion engine, especially a reciprocating internal combustion engine, with at least one cylinder having a cylinder barrel, wherein the cylinder barrel forms a guide for a piston associated with the cylinder. According to one aspect of the invention, the cylinder barrel is only partially formed by a cylinder wall of a crankcase or of a cylinder liner fastened to the crankcase, wherein the cylinder barrel in a central region, as seen in the cylinder axial direction, is formed by the crankcase-side or cylinder liner-side cylinder wall, wherein the crankcase-side or cylinder liner-side cylinder wall, in an upper region of the cylinder barrel adjoining the central region towards the top and/or in a lower region of the cylinder barrel adjoining the central region towards the bottom, has an encompassing recess, especially extending in the circumferential direction of the cylinder, into which is inserted which a one-piece or multi-piece annular sliding element, the radially inner wall of which forms a part of the cylinder barrel.

In this way, the friction between the cylinder and the piston/piston rings can be simply reduced with regard to production engineering since the crankcase-side or cylinder liner-side cylinder wall in the upper and/or lower region of the cylinder barrel now no longer has to be provided with a friction-reducing coating to reduce the friction between the cylinder and the piston/piston rings. Instead, the sliding element is now simply inserted with optimised sliding properties into the recess of the crankcase-side or cylinder liner-side cylinder wall in the upper and/or in the lower region, especially at the top dead centre point or bottom dead centre point, of the cylinder barrel. The sliding properties of the respective sliding element can in this case be optimised as desired in a particularly simple and efficient manner with regard to production engineering before its insertion into the respective recess. For example, the sliding element can be provided in a simple manner with regard to production engineering with a friction-reducing surface coating before its insertion into the recess. As a result, the process complexity and the costs in comparison to a coating of the crankcase-side or cylinder liner-side cylinder wall are significantly reduced.

In a preferred embodiment of the internal combustion engine according to the invention, the central region of the cylinder barrel is arranged such that in essence a hydrodynamic sliding bearing is formed in the region between the cylinder wall and the associated piston during operation of the internal combustion engine. Therefore, low-loss fluid friction prevails in the central region of the cylinder barrel.

As a further preference, the upper and/or the lower region of the cylinder barrel are/is arranged in such a way that mixed friction, especially mixed friction and static friction, between the respective sliding element and the associated piston prevails in these/this region(s) during operation of the internal combustion engine. Therefore, by the respective sliding element the friction between the cylinder barrel and the associated piston can be reduced in a particularly effective manner. It is preferably provided in this case that a friction coefficient between the respective sliding element and the associated piston lies within a range of between 0.01 and 0.06 in the upper and/or lower region of the cylinder barrel during operation of the internal combustion engine in order to be able to operate the internal combustion engine in a particularly efficient manner.

The upper region of the cylinder barrel is preferably formed by an upper end region of the cylinder barrel. By the same token, it is preferred that the lower region of the cylinder barrel is formed by a lower end region of the cylinder barrel.

As a further preference, the upper region of the cylinder barrel is arranged such that an outer slide wall of the associated piston is in contact with the sliding element at least at the top dead centre point (TDC) of the piston. As a result, the friction and the wear of the cylinder barrel can be reduced in a particularly effective manner. It is preferably provided in this case that the outer slide wall of the piston is in contact with the sliding element at least within a crank angle range of the internal combustion engine of between 10° crank angle before TDC and 15° crank angle after TDC. The term "piston" is previously and subsequently to be specifically understood here in a broad sense and is to include not only the piston but also the piston rings which are associated with the piston.

Alternatively and/or additionally, the lower region of the cylinder barrel can also be arranged in such a way that an outer slide track of the associated piston is in contact with the sliding element at least at the bottom dead centre point (BDC) of the piston. It is preferably provided in this case that the outer slide wall of the piston is in contact with the sliding element at least within a crank angle range of the internal combustion engine of between 10° crank angle before BDC and 15° crank angle after BDC.

In a preferred concrete embodiment, the length or height of the cylinder barrel is by a multiple larger than the height of the annular sliding element. With such a height difference, the provision of the sliding elements according to one aspect of the invention is particularly effective. As a particular preference, the length or the height of the cylinder barrel is in this case at least four times as large as the height of the annular sliding element.

As a further preference, the material of the respective sliding element and the material of the cylinder wall have a basically equal coefficient of thermal expansion. As a result, the effect of temperature-induced edges or jumps being formed between the crankcase-side or cylinder liner-side cylinder wall and the respective sliding element is reliably prevented so that a basically smoother transition between the cylinder wall and the respective sliding element always prevails. It is preferably provided in this case that the material of the sliding element and the material of the cylinder wall are in the main identically formed. In a preferred concrete embodiment, the material of the sliding element and the material of the cylinder wall are produced in this case from steel, from cast iron or from aluminium.

As a further preference, the annular sliding element is coated on the inner side with a slide coating in order to further reduce the friction and the wear of the internal combustion engine. It is preferably provided in this case that the slide coating is formed by a DLC coating and/or by an APS coating (APS: Atmospheric Plasma Spraying). The APS coating can in this case be, for example, metallically, metal-ceramically or fully ceramically formed.

Between the slide coating and a base material of the annular sliding element, especially formed by aluminium, provision is preferably made for a support layer or stabilising layer. By such a support layer, the so-called eggshell effect, that is to say breaking of the coating as a result of plastic deformation of the, for example, aluminium base material is reliably counteracted. It is preferably provided in this case that the support layer is formed by a chemical nickel coating.

As a further preference, the radial inner wall of the respective sliding element has a lower surface roughness than a wall region of the crankcase-side or cylinder liner-side cylinder wall, which forms the cylinder barrel. Therefore, friction and wear of the internal combustion engine is effectively reduced and at the same time the production of the internal combustion engine is also simplified since the cylinder wall of the crank case or of the cylinder liner, which customarily is accessible only with difficulty, is provided with a lower surface roughness than the sliding elements, which are simple to machine.

The respective sliding element is preferably in a flat abutment connection with the crankcase or the cylinder liner in order to be able to fasten the sliding element in a simple and reliable manner. As a further preference, the sliding element is connected to the crankcase or to the cylinder liner in a form-fitting and/or materially bonding manner, especially by means of an adhesive bond or a welded connection, in order to reliably fasten the sliding element to the crankcase or to the cylinder liner. The respective sliding element is preferably fastened to the crankcase or to the cylinder liner by thermal joining or mechanical pressing.

In a preferred concrete embodiment, the recess of the cylinder wall has a basically U-shaped contour, as seen in cross section, in order to design the recess in a simple and functionally optimised manner. As a further preference, the annular sliding element is of basically rectangular design in cross section in order to form the annular sliding element in a simple manner with regard to production engineering. As a further preference, the sliding element lies in the associated recess in a contour-matched manner.

Also claimed for achieving the already mentioned object is a cylinder liner set having a cylinder liner which forms a cylinder barrel. According to one aspect of the invention, the cylinder barrel is only partially formed by a cylinder wall of the cylinder liner, wherein the cylinder barrel in a central region, as seen in the cylinder axial direction, is formed by the cylinder wall of the cylinder liner, wherein the cylinder wall of the cylinder liner, in an upper region of the cylinder barrel adjoining the central region towards the top and/or in a lower region of the cylinder barrel adjoining the central region towards the bottom, has an encompassing recess, especially extending in the cylinder circumferential direction, into which can be inserted in each case a one-piece or multi-piece annular sliding element as a component part of the set, wherein a radially inner wall of the inserted sliding element forms a part of the cylinder barrel.

The advantages which ensue as a result of the cylinder liner set according to the invention are identical to the already appreciated advantages of the internal combustion engine according to the invention so that these are not repeated at this point.

Furthermore, a vehicle, especially a commercial vehicle, having the internal combustion engine according to the invention, is also claimed. The advantages which ensue as a result of the vehicle according to aspects of the invention are also identical to the already appreciated advantages of the internal combustion engine according to the invention so that these are not repeated here either.

The advantageous designs and developments of the invention, which were explained above and/or rendered in the dependent claims can, except for example in the cases of obvious dependencies or contradictory alternatives, be used individually and/or also in any combination with each other.

The invention and its advantageous designs and/or developments and also their advantages are explained in more detail below purely by way of example with reference to drawings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
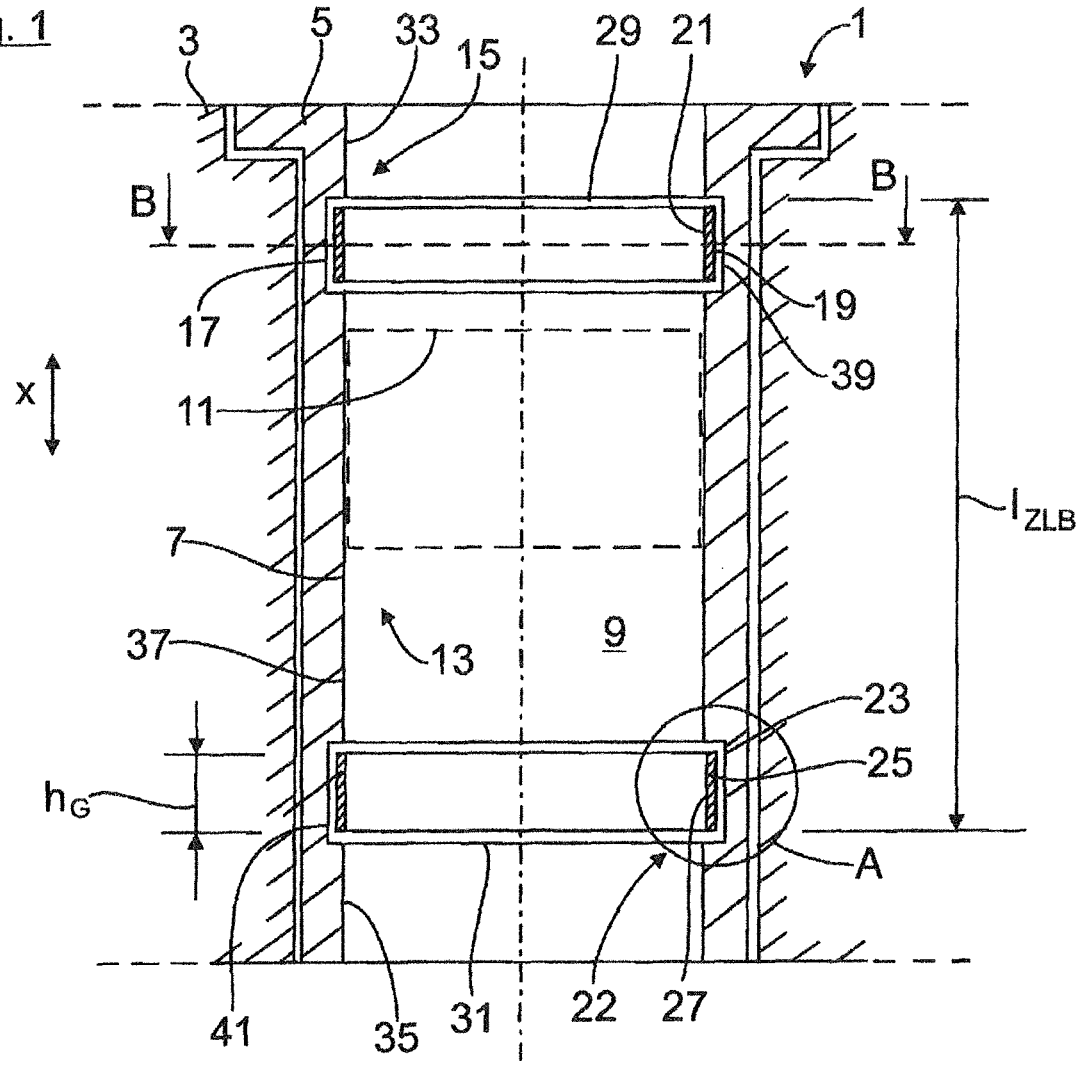
FIG. 1 is in a sectional view of a part of an internal combustion engine.

In FIG. 1, a part of an internal combustion engine 1 according to one aspect of the invention is shown in a sectional view. The internal combustion engine 1, which is designed as a reciprocating internal combustion engine, has a crankcase 3 and a cylinder liner 5 fastened to the crankcase 3. The cylinder liner 5 here by way of example is fastened to the crankcase 3 by a pressed connection.

The cylinder liner 5 has a cylinder wall 7 radially on the inside that forms a cylinder of the internal combustion engine 1, in the cylinder chamber 9 is arranged a piston 11, indicated by dashed lines, of the internal combustion engine 1. The cylinder wall 7 here forms in this case a central region 13 of a cylinder barrel, as seen in the cylinder axial direction x, by means of which the piston 11 is guided.

In an upper region 15 of the cylinder barrel, as seen in the cylinder axial direction x, adjoining the central region 13 of the cylinder barrel towards the top, the cylinder wall 7 has in this case an encompassing recess 17 into which is inserted an annular sliding element 19 which, by way of example, is in one piece. A radially inner wall 21 of the sliding element 19 also forms here a part of the cylinder barrel in this case.

According to FIG. 1, the cylinder wall 7, moreover, in a lower region 22, as seen in the cylinder axial direction x, adjoining the central region 13 towards the bottom, also has an encompassing recess 23 into which is inserted an annular sliding element 25, which by way of example is in one piece. A radially inner wall 27 of the sliding element 25 also forms a part of the cylinder barrel in the process. The sliding elements 19, 25 in this case can be fastened to the cylinder liner 5 by thermal joining or mechanical pressing. Moreover, the sliding elements 19, 25 here are by way of example of basically identical or constructionally similar design.

Furthermore, the crankcase 3 and the cylinder liner 5 are produced from cast iron (GJL) and the sliding elements 19, 25 are produced from steel. Moreover, the cylinder liner 5 and the sliding elements 19, 25 form a cylinder liner set.

The upper region 15 of the cylinder barrel or the upper sliding element 19 also form by way of example an upper end region of the cylinder barrel. Moreover, the lower region 22 or the lower sliding element 25 of the cylinder barrel also form here by way of example a lower end region of the cylinder barrel. Therefore, the cylinder barrel extends here basically from an upper side 29 of the upper sliding element 19 over a cylinder barrel length $l_{ZLB}$ to a lower side 31 of the lower sliding element 25. A height $h_G$ of the respective sliding element 19, 25 here is by way of example a multiple larger than the length or the height of the cylinder barrel $l_{ZLB}$.

Furthermore, the upper region 15 of the cylinder barrel or the sliding element 19 is also arranged here in such a way that an outer slide wall of the piston 11 is in contact or in abutment with the sliding element 19, at least at the top dead centre point (TDC) of the piston 11. Moreover, the lower region 22 of the cylinder barrel or the sliding element 25 is also arranged here in such a way that the outer slide wall of the piston 11 is in contact or in abutment with the sliding element 25 at the bottom dead centre point (BDC) of the piston 11.

As shown in FIG. 1, the cylinder wall 7 of the cylinder liner 5 continues upwards here above the recess 17 with a wall region 33. Moreover, the cylinder wall 7 continues downwards here below the recess 23 with a wall region 35. The wall regions 33, 35 and also a wall region 37 of the cylinder wall 7, which is located between the recesses 17, 23, have by way of example an identical diameter. In the recesses 17, 23 of the cylinder wall 7 or in wall regions 39, 41 of the cylinder wall 7 which form the recesses 17, 23 the diameter of the cylinder wall 7 is enlarged in comparison to the wall regions 33, 35, 37.

Furthermore, the central region 13 of a cylinder barrel or the wall region 37 of the cylinder wall 7 is arranged such that in essence a hydrodynamic sliding bearing is formed between the wall region 37 of the cylinder wall 7 and the piston 11 during operation of the internal combustion engine 1. Moreover, the upper region 15 and the lower region 22 of the cylinder barrel or the recesses 17, 23 of the cylinder wall 7 are arranged in such a way that mixed friction between the sliding elements 19, 25 and the piston 11 prevails in these regions during operation of the internal combustion engine 1. Therefore, the sliding elements 29, 25 here are arranged in those regions of the cylinder barrel in which friction, and therefore also a relatively high energy loss, occurs during operation of the internal combustion engine 1.

Figure 2:
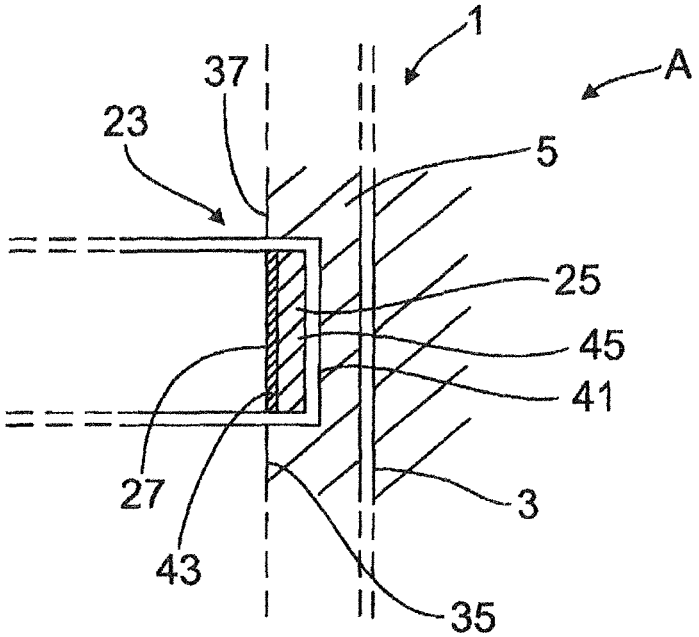
FIG. 2 is the detail A from FIG. 1 in an enlarged view.

As shown in FIG. 2, the respective recess 17, 23 or the respective wall region 39, 41 of the cylinder wall 7 has a basically U-shaped contour, as seen in cross section. Moreover, the respective sliding element 19, 25 according to FIG. 2 is of rectangular design in cross section. Furthermore, the respective sliding element 19, 25 here by way of example lies in the respectively associated recess 17, 23 in a contour-matched manner so that the respective sliding element 19, 25, with the exception of the respective radially inner sliding element wall 21, 27, is in abutment with the respective wall region 39, 41 of the cylinder wall 7. Therefore, the sliding elements 19, 25 here are also in flat abutment contact with the cylinder liner 5 and are connected in a form-fitting manner to the cylinder liner.

In FIG. 2, the respective sliding element 19, 25 here is also coated on the inner side or radially on the inside with a slide coating 43 by which the friction between the sliding elements 19, 25 and the piston 11 is reduced. This slide coating 43 is preferably formed by a DLC coating or by an APS coating. The slide coating 43 here is applied in this case directly to the basic body 45, formed by steel here by way of example, of the respective sliding element 19, 25. Furthermore, the radially inner wall 21, 27 of the respective sliding element 19, 25 here by way of example also has a lower surface roughness than the wall region 37 of the cylinder wall 7.

Figure 3:
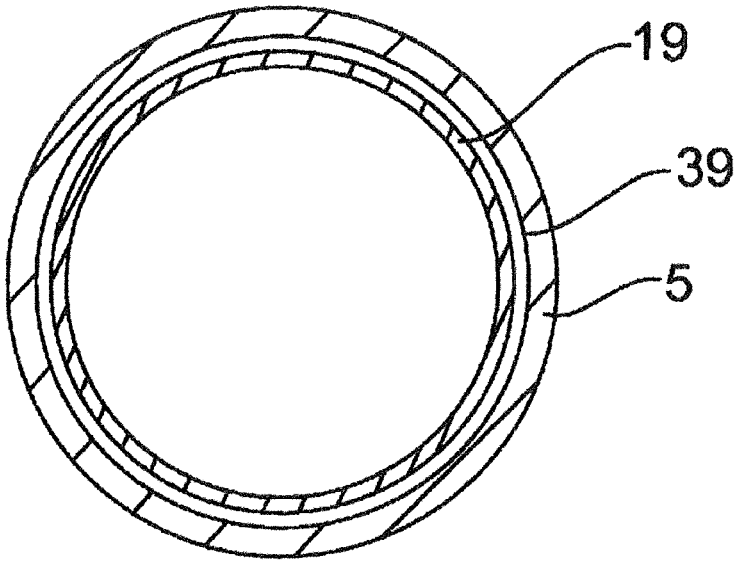
FIG. 3 is a sectional view along the intersecting plane B-B from FIG. 1.

As shown in FIG. 3, the respective sliding elements 19, 25 are formed in one piece or by a ring, which is closed in the circumferential direction.

Figure 4:
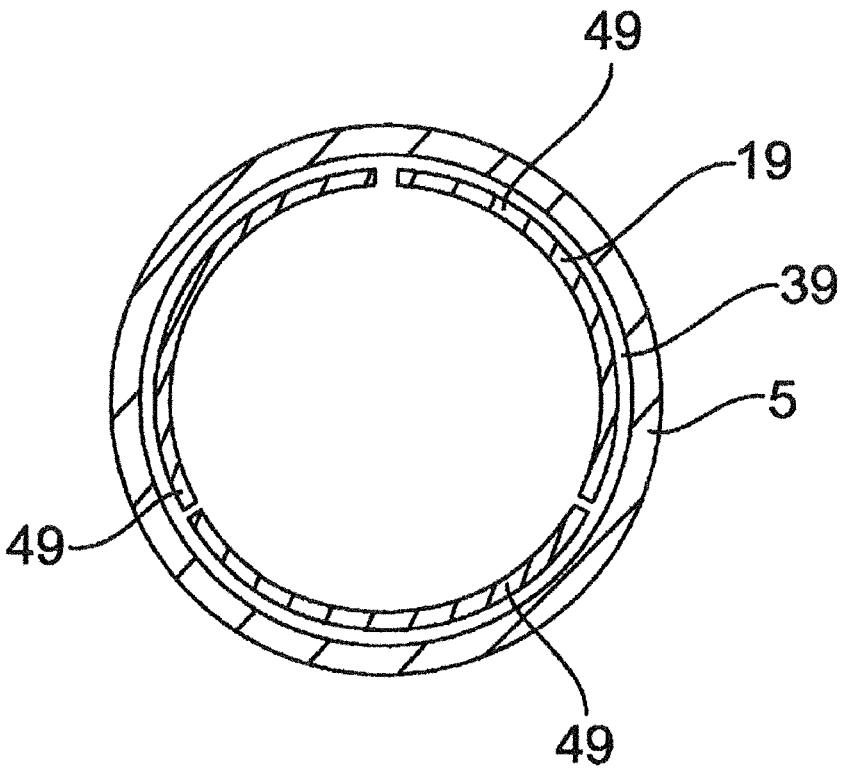
FIG. 4 is in a view according to FIG. 3 of the internal combustion engine.

In FIG. 4, a second embodiment of the internal combustion engine 1 according to the invention is shown. In comparison to the first embodiment of the internal combustion engine 1 which is shown in FIG. 3, the respective sliding elements 19, 25 are not designed in one piece but in a plurality of pieces. The respective sliding element 19, 25 here is assembled in this case from a plurality of ring segments 49, by way of example from three ring segments 49 here. The ring segments 49 here are of basically constructionally similar or identical design in this case.

Figure 5:
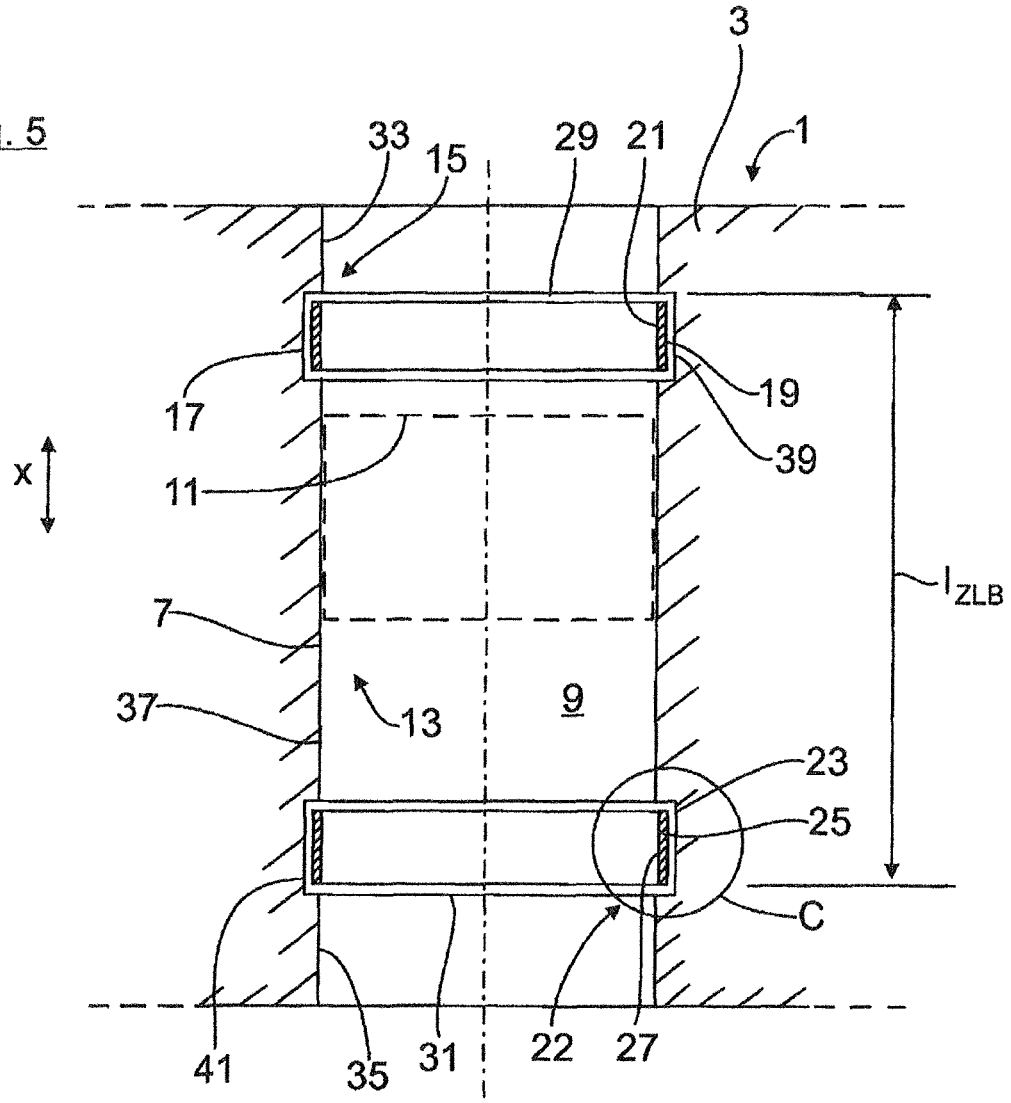
FIG. 5 is in a view according to FIG. 1 a third embodiment of the internal combustion engine according to the invention.

In FIG. 5, a third embodiment of the internal combustion engine 1 is shown. In comparison to the first embodiment which is shown in FIG. 1, the internal combustion engine 1 here has no cylinder liner 5. Instead of this, the cylinder wall 7 which forms the cylinder is formed here by the crankcase 3 itself. Furthermore, the crankcase 3 and the sliding elements 19, 25 here are not produced from steel but from aluminium.

Figure 6:
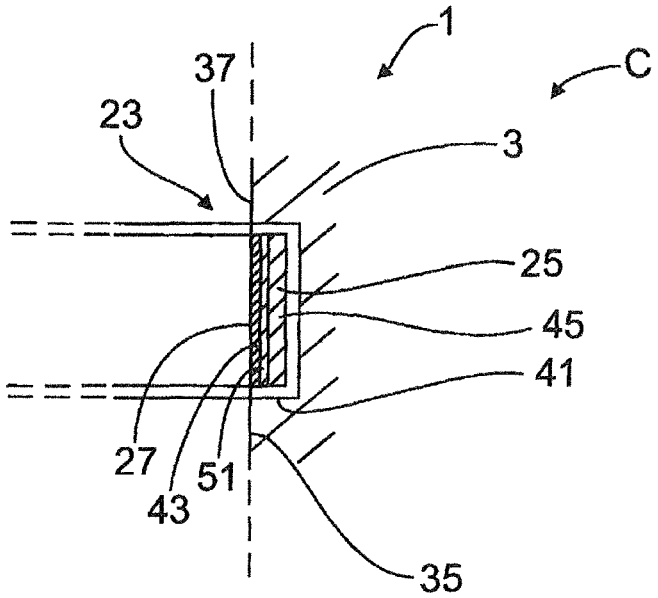
FIG. 6 is the detail C from FIG. 5 in an enlarged view.

As also emerges from FIG. 6, provision is made here, moreover, between the slide coating 43 and the basic body—formed here by aluminium—of the respective sliding element 19, 25 for a support layer 51 by which the stability of the slide coating 43 is increased or the eggshell effect of the slide coating 43 is counteracted.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An internal combustion engine, comprising:

a piston;

a crankcase;

at least one cylinder having a cylinder barrel, the cylinder barrel forms a guide for the piston associated with the cylinder, the cylinder barrel is only partially formed by a cylinder wall of the crankcase or a cylinder liner fastened to the crankcase; and one of a one-piece and a multi-piece annular sliding element, wherein the cylinder barrel, in a central region as seen in a cylinder axial direction, is formed by the cylinder wall, wherein the cylinder wall, in an upper region of the cylinder barrel adjoining the central region towards the top and/or in a lower region of the cylinder barrel adjoining the central region towards the bottom, has an encompassing recess, extending in a circumferential direction of the cylinder, into which is inserted in each case the one of the one-piece and multi-piece annular sliding element, a radially inner wall of which forms a part of the cylinder barrel;

wherein the annular sliding element is coated on the inner side with a slide coating, wherein a single support layer is provided between the slide coating and a base material formed by aluminium, and wherein the single support layer is formed by a chemical nickel coating.

2. The internal combustion engine according to claim 1, wherein the central region of the cylinder barrel is arranged such that a hydrodynamic sliding bearing is formed between the cylinder wall and the associated piston during operation of the internal combustion engine.

3. The internal combustion engine according to claim 1, wherein at least one of the upper and lower region of the cylinder barrel is arranged such that mixed friction between the respective sliding element and the associated piston prevails in these/this region(s) during operation of the internal combustion engine, wherein a friction coefficient between the respective sliding element and the associated piston lies within a range of between 0.01 and 0.06 in at least one of the upper and lower region of the cylinder barrel during operation of the internal combustion engine.

4. The internal combustion engine according to claim 1, wherein the upper region of the cylinder barrel forms an upper end region of the cylinder barrel, and in that the lower region of the cylinder barrel forms a lower end region of the cylinder barrel.

5. The internal combustion engine according to claim 1, wherein the upper region of the cylinder barrel is arranged such that an outer slide wall of the associated piston is in contact with the sliding element at least at a top dead centre point (TDC) of the piston.

6. The internal combustion engine according to claim 1, wherein the lower region of the cylinder barrel is arranged such that an outer slide wall of the associated piston is in contact with the sliding element at least at a bottom dead centre point (BDC) of the piston.

7. The internal combustion engine according to claim 1, wherein a length (lZLB) of the cylinder barrel is larger by a multiple, than a height of the annular sliding element.

8. The internal combustion engine according to claim 1, wherein a material of the sliding elements and a material of the cylinder wall have a substantially equal coefficient of thermal expansion.

9. The internal combustion engine according to claim 1, wherein the radially inner wall of the respective sliding element has a lower surface roughness than a wall region of the crankcase-side or cylinder liner-side cylinder wall which forms the cylinder barrel.

10. The internal combustion engine according to claim 1, wherein the sliding element is one of:

in flat abutment contact with the crankcase or the cylinder liner, and connected in a materially bonding manner to the crankcase or to the cylinder liner.

11. The internal combustion engine according to claim 1, wherein at least one of:

The encompassing recess of the cylinder wall has a substantially U-shaped contour, as seen in cross section, the annular sliding element is of rectangular design in cross section, and the sliding element lies in the associated encompassing recess in a contour-matched manner.

12. The internal combustion engine according to claim 1, wherein the internal combustion engine is a reciprocating internal combustion engine.

13. The internal combustion engine according to claim 1, wherein the upper region of the cylinder barrel is arranged such that an outer slide wall of the associated piston is in contact with the sliding element at least within a crank angle range of the internal combustion engine of between 10° crank angle before TDC and 15° crank angle after TDC.

14. The internal combustion engine according to claim 1, wherein the lower region of the cylinder barrel is arranged such that an outer slide wall of the associated piston is in contact with the sliding element at least within a crank angle range of the internal combustion engine of between 10° crank angle before BDC and 15° crank angle after BDC.

15. The internal combustion engine according to claim 7, wherein the multiple is at least four.

16. The internal combustion engine according to claim 8, wherein the material of the sliding element and the material of the cylinder wall are of substantially identical design and/or are produced from steel, from cast iron or from aluminium.

17. The internal combustion engine according to claim 16, wherein the material of the sliding element and the material of the cylinder wall are produced from steel, cast iron, or aluminium.

18. The internal combustion engine according to claim 1, wherein the slide coating is formed by at least one of a DLC coating and an APS coating.

19. The internal combustion engine according to claim 1, the support layer is formed by a chemical nickel coating.

20. The internal combustion engine according to claim 1, wherein the cylinder wall in the upper and/or lower region of the cylinder barrel is not provided with a friction-reducing coating in order to reduce the friction between the cylinder and the piston, and wherein the annular sliding element is provided with the slide coating before its insertion into the recess.

21. A cylinder liner set for an internal combustion engine comprising a cylinder liner forming a cylinder barrel that is only partially formed by a cylinder wall of the cylinder liner;

a central region of the cylinder barrel, in as seen in a cylinder axial direction, is formed by the cylinder wall of the cylinder liner;

an encompassing recess extending in the cylinder circumferential direction arranged in at least one of an upper region of the cylinder barrel adjoining the central region towards the top and in a lower region of the cylinder barrel adjoining the central region towards the bottom; and a one-piece or multi-piece annular sliding element configured to be inserted into a respective encompassing recess, wherein a radially inner wall of the inserted sliding element forms a part of the cylinder barrel;

wherein the annular sliding element is coated on the inner side with a slide coating, wherein a single support layer is provided between the slide coating and a base material formed by aluminium, and wherein the single support layer is formed by a chemical nickel coating.

22. A vehicle, comprising, an internal combustion engine internal combustion engine, comprising:

a piston;

a crankcase;

at least one cylinder having a cylinder barrel, the cylinder barrel forms a guide for the piston associated with the cylinder, the cylinder barrel is only partially formed by a cylinder wall of the crankcase or a cylinder liner fastened to the crankcase; and one of a one-piece and a multi-piece annular sliding element, wherein the cylinder barrel, in a central region as seen in the cylinder axial direction, is formed by the cylinder wall, wherein the cylinder wall, in an upper region of the cylinder barrel adjoining the central region towards the top and/or in a lower region of the cylinder barrel adjoining the central region towards the bottom, has an encompassing recess, extending in a circumferential direction of the cylinder, into which is inserted in each case the one of the one-piece and multi-piece annular sliding element, a radially inner wall of which forms a part of the cylinder barrel;

wherein the annular sliding element is coated on the inner side with a slide coating, wherein a single support layer is provided between the slide coating and a base material formed by aluminium, and wherein the single support layer is formed by a chemical nickel coating.

* * * * *